US008890011B2

(12) United States Patent
Cortinovis et al.

(10) Patent No.: US 8,890,011 B2
(45) Date of Patent: Nov. 18, 2014

(54) MEDIUM VOLTAGE CIRCUIT BREAKER

(75) Inventors: Gianluca Cortinovis, Albino (IT); Giorgio Moriconi, Torre Boldone (IT); Pierino Bertolotto, Bergamo (IT)

(73) Assignee: ABB Technology AG, Zurich (CH)

( * ) Notice: Subject to any disclaimer, the term of this patent is extended or adjusted under 35 U.S.C. 154(b) by 676 days.

(21) Appl. No.: 12/973,133

(22) Filed: Dec. 20, 2010

(65) Prior Publication Data

US 2011/0155547 A1 Jun. 30, 2011

(30) Foreign Application Priority Data

Dec. 29, 2009 (EP) ..... 09180911

(51) Int. Cl.

| | |
|---|---|
| ***H01H 1/64*** | (2006.01) |
| ***H01H 9/02*** | (2006.01) |
| ***H01H 13/00*** | (2006.01) |
| *H01H 33/666* | (2006.01) |
| *H01H 33/662* | (2006.01) |
| *H01H 3/02* | (2006.01) |

(52) U.S. Cl.

CPC ..... *H01H 33/666* (2013.01); *H01H 2033/6665* (2013.01); *H01H 2033/6623* (2013.01); *H01H 3/0213* (2013.01)

USPC ..... 200/293

(58) Field of Classification Search

USPC ..... 200/16 A, 49

See application file for complete search history.

(56) References Cited

U.S. PATENT DOCUMENTS

| | | | | |
|---|---|---|---|---|
| 7,692,113 | B2 * | 4/2010 | Meinherz | 218/43 |
| 2007/0151953 | A1 * | 7/2007 | Meinherz | 218/155 |
| 2011/0062004 | A1 * | 3/2011 | Spitsberg et al. | 200/293 |
| 2012/0320487 | A1 * | 12/2012 | Cortinovis et al. | 361/115 |

FOREIGN PATENT DOCUMENTS

| | | | |
|---|---|---|---|
| EP | 1580783 | A1 | 9/2005 |
| EP | 1653492 | A1 | 5/2006 |
| WO | WO-01/86678 | A2 | 11/2001 |

OTHER PUBLICATIONS

Extended European Search Report issued in corresponding European Application No. 09180911.1 dated Jun. 15, 2010.

* cited by examiner

*Primary Examiner* — Renee Luebke
*Assistant Examiner* — Leheiren Mae A Caroc
(74) *Attorney, Agent, or Firm* — Novak Druce Connolly Bove + Quigg LLP

(57) ABSTRACT

A Medium Voltage circuit breaker which comprises a pole assembly having, for each phase, an interruption chamber housing a first fixed contact and a second movable contact reciprocally couplable/uncouplable between an open and close position; the Medium Voltage circuit breaker further comprises an actuator to actuate the opening and closing operation of said circuit breaker and an insulating base frame supporting said pole assembly and said actuator.

17 Claims, 5 Drawing Sheets

MEDIUM VOLTAGE CIRCUIT BREAKER

CROSS REFERENCE TO RELATED APPLICATIONS

This application claims priority to Application No. 09180911.1 filed in Europe on Dec. 29, 2009 under 35 U.S.C. §119, the entire contents of which are hereby incorporated by reference.

The present invention relates to a medium voltage circuit breaker with improved features, and in particular to a medium voltage circuit breaker having a simplified structure. For the purposes of the present application the term medium voltage is referred to applications in the range of between 1 and 52 kV.

Medium voltage circuit breaker are well known in the art. They usually consist of a pole assembly having, for each phase, a fixed contact and a movable contact. This latter is typically movable between a first position, in which it is coupled to the fixed contact, and a second position, in which it is uncoupled from said fixed contact, thereby realizing the opening and closing operation of the circuit breaker.

The pole assembly is usually mounted on a base frame which is generally made of many separate components of metallic material, assembled by screws and/or welding. An actuator, for actuating the opening and closing operation of the circuit breaker, and a kinematic chain, linking the actuators to the movable contacts, are usually also mounted onto the base frame.

The usual assembly processes of the circuit breaker, normally foresee a number of steps in which some of the components of the frame are assembled before mounting the actuator, poles and kinematic chain, while some others components of the frame are assembled after the actuator, poles and kinematic chain have been mounted.

The known production processes of medium voltage circuit breakers are therefore long and complicated.

Another problem of the circuit breaker of known type is that, with a metal base frame, it is necessary to have a long insulation distance, in order to reach the required insulation level. In particular, if a current path exit through the lower base is desired, it is necessary to adopt complicated and costly solutions based on bushings.

Also for this reason most circuit breaker solutions of known type include contact arms which are perpendicular to the longitudinal axis of the interruption unit thereby increasing the electrodynamic stress, due to the non-linear path of the current.

A further disadvantage of circuit breakers of known type is due to their poor flexibility in terms of application since, in general, a number of different circuit breaker configurations are needed in order to realize different panel configurations.

It is therefore an object of the present invention to provide a medium voltage circuit breaker in which the above-mentioned drawbacks are avoided or at least reduced.

More in particular, it is an object of the present invention to provide a medium voltage circuit breaker whose production process is greatly simplified with respect to the conventional circuit breaker.

As a further object, the present invention is aimed at providing a medium voltage circuit breaker having a reduced number of mechanical parts.

A further object of the present invention is to provide a medium voltage circuit breaker that can be easily adapted to different panel configurations.

Still a further object of the present invention is to provide a medium voltage circuit breaker in which the various sub-components of the circuit breaker (e.g. pole assembly, actuator, kinematic chain) can be pre-assembled outside the main production line of the circuit breaker.

Another object of the present invention is to provide a medium voltage circuit breaker in which the electrodynamic stresses are reduced.

Another object of the present invention is to provide a medium voltage circuit breaker having a current path exit through the lower base, without resorting to complicated and costly solutions.

Still another object of the present invention is to provide a medium voltage circuit breaker with reduced manufacturing, installation and maintenance costs.

Thus, the present invention relates to a Medium Voltage circuit breaker which is characterized in that it comprises a pole assembly having, for each phase, an interruption chamber housing a first fixed contact and a second movable contact reciprocally couplable/uncouplable between an open and close position, said circuit breaker further comprises an actuator to actuate the opening and closing operation of said circuit breaker and an insulating base frame supporting said pole assembly and said actuator.

In this way, it is possible to overcome some of the disadvantages and drawbacks of the circuit breaker of the known art.

In particular, the use of an insulating base frame for supporting the pole assembly and said actuator allows to greatly simplify the production process of the circuit breaker. In practice, all components of the circuit breaker (pole assembly, actuator, kinematic chain, possible auxiliary equipment) can be pre-assembled separately and then fixed in one step to the insulating base frame, which is preferably made in one single piece.

Also, since the main sub-assemblies of the circuit breaker (pole assembly, actuator, kinematic chain) can be fixed to the insulating base frame from the same side thereof (e.g. from the bottom of the insulating base frame), it is possible to highly automatize the assembly process, thereby considerably reducing the required manwork, and consequently reducing the manufacturing costs.

Another important advantage derives form the fact that, being the base frame made of insulating material, it is possible to realize the current path exit through the lower base, without the need to use complicated and costly solutions based on bushings.

At the same time, as better explained in the following description, it is possible to realize a linear current path minimizing the current path itself and avoiding current turns, thereby permitting to optimize the heating effects, to reduce the electrodynamic mechanical stresses and to design a cheaper switchgear.

Another important advantage is that the circuit breaker configuration can be easily changed thereby adapting it to the needs. For instance, the circuit breaker fixed version is easily modifiable in withdrawable version by adding a few accessories (e.g., contacts or circuit breaker arms and contacts).

Preferably, the Medium Voltage circuit breaker according to the invention comprises a kinematic chain operatively connecting the actuator to the movable contact, said kinematic chain being housed in said insulating base frame.

According to a preferred embodiment of the invention, the insulating base frame is made in one piece.

The circuit breaker of the invention can have a connection on the back part of the poles so as to realize a traditional solution. However, it preferably has a plug directly assembled on the poles and on the base so as to have a linear current path.

In a preferred embodiment, the pole assembly may comprise, for each phase, at least a first terminal comprising a circuit breaker arm electrically connected to a corresponding fixed or movable contact, said circuit breaker arm being substantially aligned with the longitudinal axis of the interruption chamber of the corresponding phase.

In such a case, said terminal may comprise an insertion contact (e.g. tulip or sliding contact) electrically connected to a corresponding fixed or movable contact through said circuit breaker arm.

According to a particular embodiment of the Medium Voltage circuit breaker of the invention, the circuit breaker arm comprises an insulating bushing of standard type.

Alternatively, said circuit breaker arm comprises a grading bushing having an insulation system based on grading capacitors electrical field control.

In such a case, said grading capacitors electrical field control can conveniently comprise, on the external surface of said circuit breaker arm, a metallic concentric layer.

According to a preferred embodiment of the Medium Voltage circuit breaker of the invention, said kinematic chain comprises a sliding element which is operatively connected to said actuator, said sliding element having a first sliding surface operatively coupled to said movable contact and being movable between a first open position and a second closed position.

Preferably, said sliding element is made of insulating material.

In such a case, the movement of movable contact is obtained without any permanent mechanical connection between the movable contact assembly and the kinematic chain. As better shown in the following detailed description, in the circuit breaker of the invention the movement is obtained with sliding coupling of the movable contact assembly with the sliding surface of the sliding element in the kinematic chain. The number of components is therefore greatly reduced, with consequent reduction of costs and time of manufacturing, installation and maintenance.

Advantageously, the Medium Voltage circuit breaker of the invention can further comprise a control box housing one or more auxiliary device of said circuit breaker.

In a particular embodiment of the Medium Voltage circuit breaker according to the invention, the insulating base frame comprises a base wall and a first, a second and a third lateral walls, a plurality of fixing point being present in the volume defined by said base and lateral walls for fixing said pole assembly and said actuator to said insulating base frame.

Further characteristics and advantages of the invention will emerge from the description of preferred, but not exclusive embodiments of a Medium Voltage circuit breaker according to the invention, non-limiting examples of which are provided in the attached drawings, wherein.

With reference to the attached figures, a Medium Voltage circuit breaker according to the invention, designed with the reference number 1, in its more general definition, comprises a pole assembly 2 having, for each phase, an interruption chamber housing a first fixed contact and a second movable contact. (Fixed and movable contacts are not shown in the attached drawings). Normally the circuit breaker is a three-phase circuit breaker and thus comprises three interruption chambers 6, 7, and 8 which house corresponding sets of fixed/movable contacts reciprocally couplable/uncouplable between an open and close position. Fixed and movable contacts can be conventional contacts of known type and therefore will not be described in more details.

Figure 1:
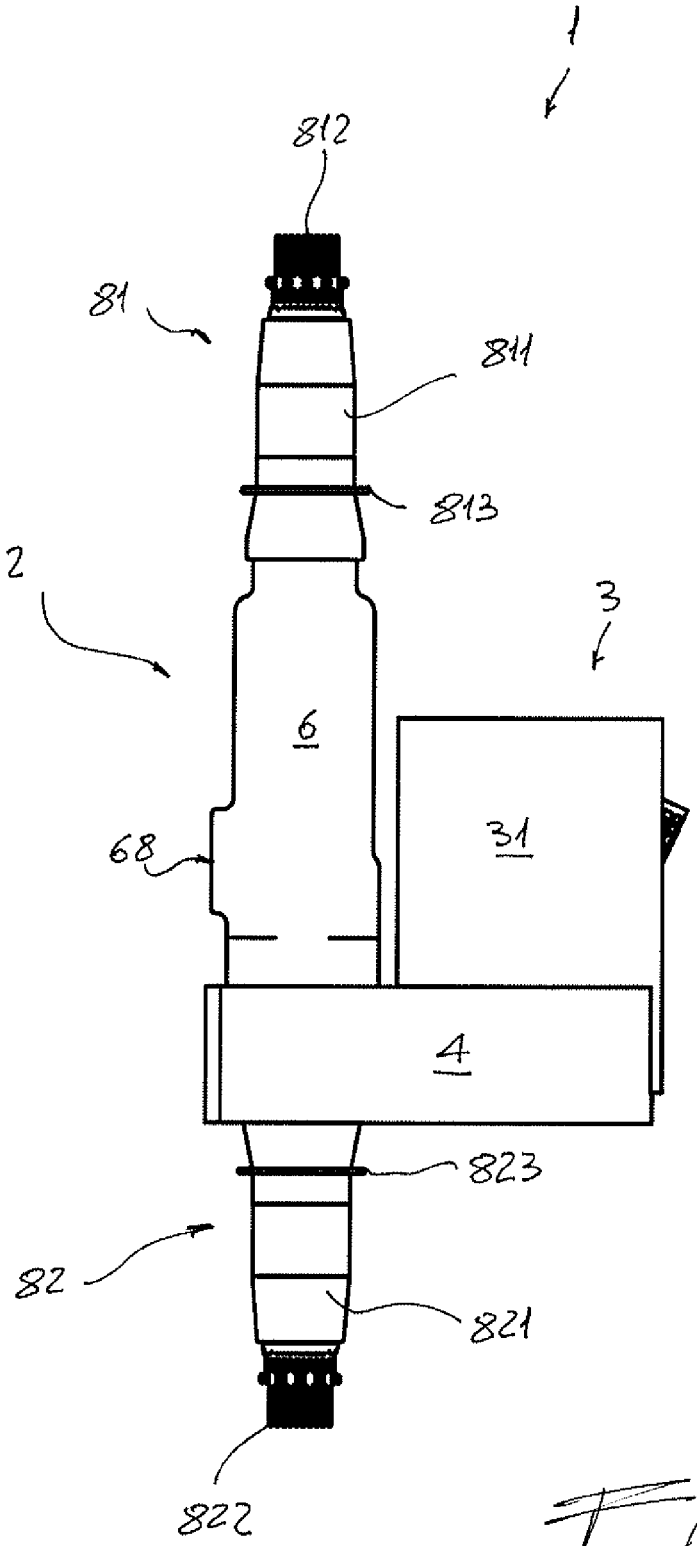
FIG. 1 is a schematic side view of a first embodiment of a Medium Voltage circuit breaker according to the invention.
Figure 2:
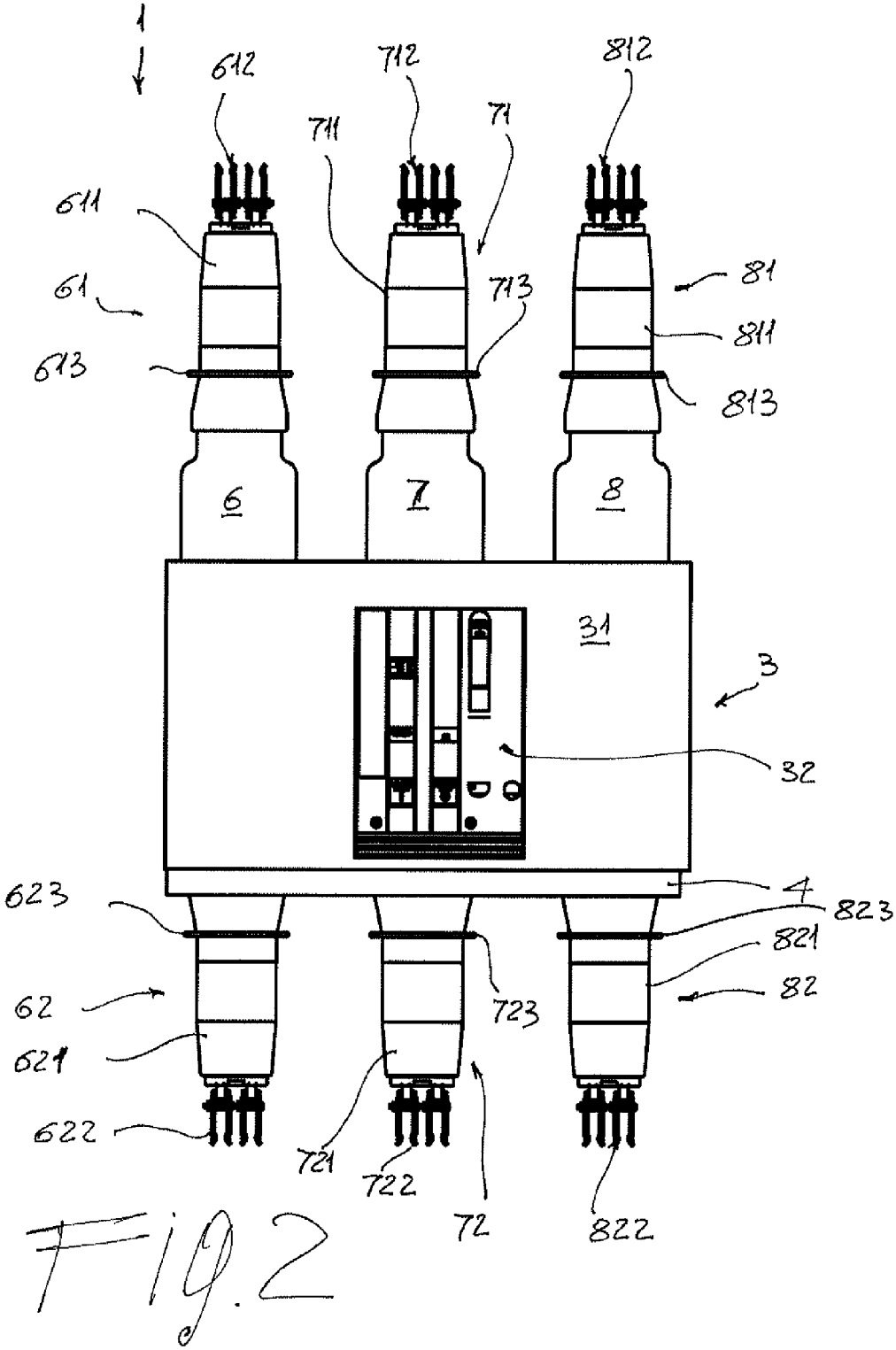
FIG. 2 is a schematic front view of the Medium Voltage circuit breaker of FIG. 1.
Figure 4:
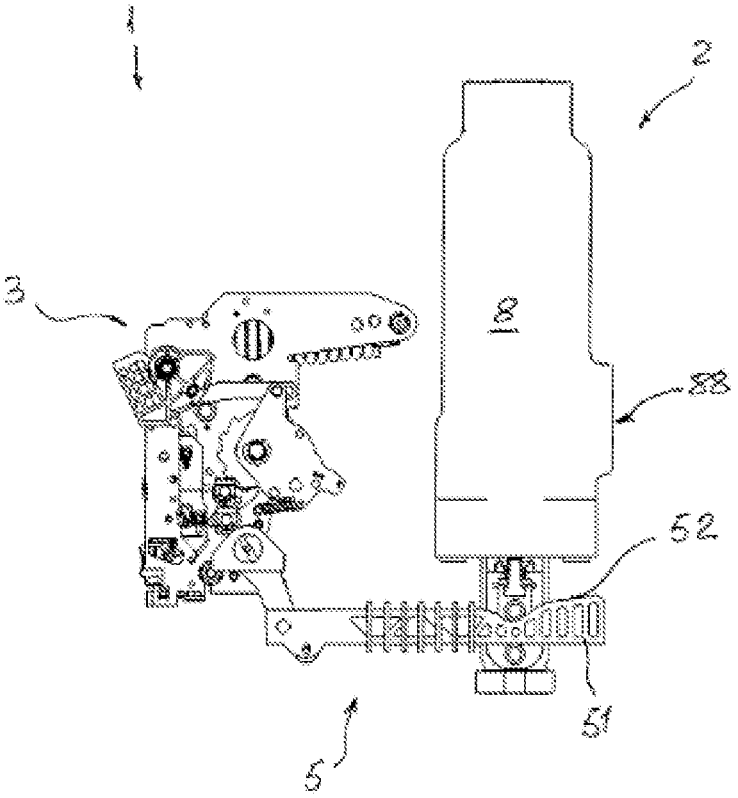
FIG. 4 is a schematic side view illustrating some components of a particular embodiment of a Medium Voltage circuit breaker according to the invention.

The circuit breaker according to the invention further comprises an actuator 3 to actuate the opening and closing operation of said circuit breaker. As shown in FIG. 4, the actuator 3 comprises an actuating mechanism connected to the movable contact assembly. As shown in FIGS. 1 and 2, the actuating mechanism is usually housed in a casing 31 and an operating interface 32 is also usually present. For the purposes of the present invention, the actuator can be a conventional actuator of known type and therefore will not be described in more details, being known per se.

One of the characterizing features of the Medium Voltage circuit breaker according to the invention resides in that it comprises an insulating base frame 4 supporting said pole assembly 2 and said actuator 3.

The use of the insulating base frame 4 has a number of advantages with respect to conventional circuit breaker with an assembled base frame made of many metallic parts.

Figure 3:
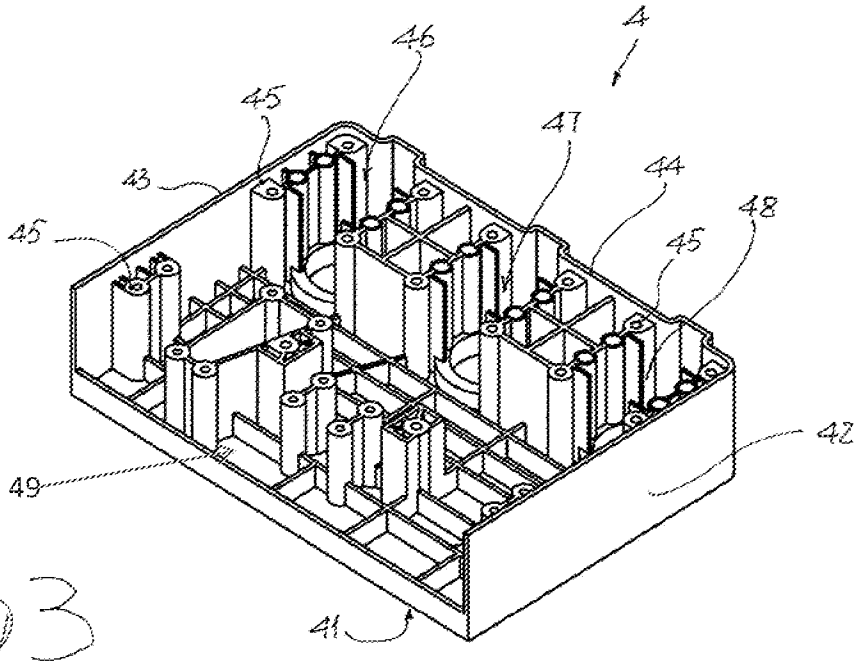
FIG. 3 is a perspective view of an insulating base frame of a Medium Voltage circuit breaker according to the invention.

As a first advantage, the manufacturing process is greatly simplified since, in practice, the various components of the circuit breaker are fixed to the insulating base frame 4, e.g. using screw means. As shown in FIG. 3, said insulating base frame can advantageously be made in one piece. In such a case, the insulating base frame 4 can conveniently comprise a base wall 41 and a first 42, a second 43 and a third 44 lateral walls which define an internal volume. Inside said volume, a plurality of fixing point 45 are present and are used for fixing said pole assembly 2 and said actuator 3 to the insulating base frame 4.

Thus, in order to assembly the various components, it is sufficient to position the individual poles 6, 7, and 8 in correspondence of the cavities 46, 47 and 48 while the actuator 3 is positioned in correspondence of the front portion 49 of the insulating base frame 4. Then, fixing means, for instance screw means, can be used to fix the poles 6, 7, and 8 and the actuator 3 to the insulating base frame 4. In such a case, as shown in FIG. 3, the screw means can be inserted in the corresponding seats 45 from the same side, i.e. from the bottom of the base wall 41 of the insulating base frame. Therefore, the assembly process is extremely simple and can be highly automatize, thereby contributing to the reduction of the manufacturing times and costs.

A further advantage in connection with the use of the insulating base frame 4, derives from the possibility of having a linear current path throughout the circuit breaker 1, without the need of using complicated and costly systems.

Figure 5:
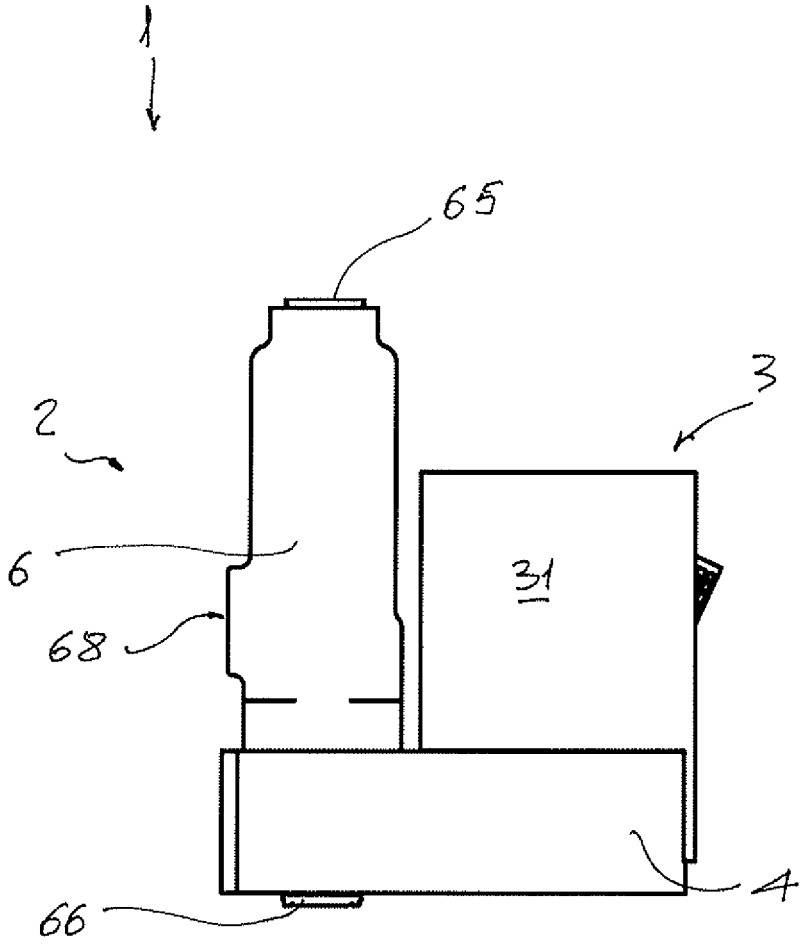
FIG. 5 is a schematic side view of a second embodiment of a Medium Voltage circuit breaker according to the invention.

With reference to FIG. 5, the circuit breaker 1 in its more general and simple embodiment, comprises connection plugs 65 and 66 directly connected to the poles 6, 7, 8 and to the insulating base frame 4, respectively. In practice, the plug 66 can be fixed to the insulating base frame, e.g. in the cavities 46, 47 and 48 of the insulating base frame 4 of FIG. 3, before connecting the poles 6, 7, 8 to the base 4. In turn, the poles 6, 7, 8 are preferably of the embedded type (i.e. they have compression and opening spring housed inside their casing with non need of insulating transmission) and include a connection plug 65 at the top end thereof.

In this way it is possible to have, in a very simple manner, a linear current path, i.e. a current path form plug 65 to plug 66 that, for each phase, is substantially parallel to the longitudinal axis of the corresponding interruption chamber 6, 7, and 8. Thus, electrodynamic stresses due to non-linear current paths are greatly reduced.

However, in addition to the live exits with plugs 65 and 66, the circuit breaker 1 of the invention can conveniently have a connection 68 also on the back part of the poles so as to realize a traditional solution, i.e. a solution in which the live exit 68 is positioned so as to create a current path that is perpendicular to the longitudinal axis of the interruption chambers 6, 7, and 8. This allows the circuit breaker 1 of the invention to be used also in conventional panels, i.e. in panels configured so as to have a circuit breaker entry and exit perpendicular to each other.

Then, starting form the basic configuration of FIG. 5 and depending on the intended applications, the circuit breaker 1 of the invention can be equipped with accessories, such as circuit breaker arms and insertion contacts, so as to make it suitable for use in the particular intended application (e.g. fixed configuration, withdrawable configuration, panels with insulating partitioning, panels with metallic partitioning, and so on)

Thus according to a particular embodiment, the Medium Voltage circuit breaker 1 according to the invention can be equipped with a pole assembly 2 which can comprises, for each phase, at least a first terminal 61,62; 71,72; 81,82 that comprises a corresponding circuit breaker arm 611,621; 711, 721; 811,821 electrically connected to a corresponding fixed or movable contact.

As shown in the attached FIGS. 1 and 2, said circuit breaker arm 611,621; 711,721; 811,821 is substantially aligned with the longitudinal axis of the interruption chamber of the corresponding phase 6, 7, and 8, thereby realizing a linear current path.

When the circuit breaker is used in a withdrawable configuration, in order to realize the insertion and/or grounding positions of the Medium Voltage circuit breaker according to the invention, the terminals 61,62; 71,72; 81,82 of the circuit breaker can conveniently comprise an insertion contact 612, 622; 712,722; 812,822 which is electrically connected to a corresponding fixed or movable contact through the corresponding circuit breaker arm 611,621; 711,721; 811,821.

As an example, the insertion contact 612,622; 712,722; 812,822 can be a conventional tulip or sliding contact.

According to a particular embodiment, not shown in the figures, the Medium Voltage circuit breaker 1 of the invention is equipped with arms 611,621; 711,721; 811,821 comprising an insulating bushing, i.e. an insulating bushing of conventional type.

Alternatively, and depending on the intended application, the Medium Voltage circuit breaker 1 of the invention can be equipped with arms 611,621; 711,721; 811,821 which comprise a grading bushing having, e.g. an insulation system based on grading capacitors electrical field control.

The grading capacitors electrical field control allows to minimize the radial insulating dimension of the arms 611, 621; 711,721; 811,821. As shown in FIGS. 1 and 2, the grading capacitors electrical field control can conveniently comprise, on the external surface of said circuit breaker arm 611,621; 711,721; 811,821, a metallic concentric layer 613, 623; 713,723; 813,823 that can be put in connection to ground.

Grounding of the metallic concentric layers 613,623; 713, 723; 813,823 can be achieve, according to a particularly preferred embodiment not shown in details in the present application, by putting in connection said metallic concentric layers with the shutters of the metallic partitioning system of the medium voltage panel in which the circuit breaker 1 of the invention is installed.

According to a particularly preferred embodiment of the Medium Voltage circuit breaker 1 of the invention, the circuit breaker 1 comprises a kinematic chain 5 which operatively connects said actuator 3 to a movable contact of at least one of said interruption chambers 6, 7 and 8. According to such embodiment, said kinematic chain is conveniently housed in said insulating base frame 4.

In particular, with reference to FIG. 4, the kinematic chain 5 can be housed inside the volume defined by the base wall 41 and by the lateral walls 42, 43 and 44 of the insulating base frame 4 in a position comprised between the front portion 49 of the insulating base frame 4 and the cavities 46, 47 and 48 aimed at housing the terminals part of the interruption chambers 6, 7 and 8.

With reference to FIG. 4, according to a particular embodiment of the Medium Voltage circuit breaker 1 of the invention, said kinematic chain 5 can conveniently comprise a sliding element 51 which is operatively connected to said actuator 3. According to such embodiment, the sliding element 51 preferably has a first sliding surface 52 which is operatively coupled to said movable contact and which is movable between a first, open, position and a second, closed, position.

In practice, starting form the situation shown in FIG. 4 (corresponding to an open position of the contacts), when a closing operation is launched, the actuators 3 moves the first sliding element 51 of the kinematic chain 5 towards the left, until the closed position of the contact is reached.

During this movement, the sliding surface 52 of the sliding element 51 interacts with the movable contact assembly through a coupling element, e.g. a roller, which slides on said surface 52. Since the profile of the sliding surface 52 is not flat, during the leftward movement of the sliding element 51, motion is transmitted to the movable contact assembly which is moved upwardly until the closed position is reached.

The opening operation is carried out in the opposite way. Thus, starting from a closed position of the contacts (not shown) when an opening operation is launched, the actuators 3 moves the first sliding element 51 of the kinematic chain 5 towards the right, until the open position of FIG. 4 is reached.

In this case, during the rightward movement of the sliding element 51, the movable contact assembly is allowed to move downwardly until the open position of FIG. 4 is reached.

It is therefore clear from the above that, according to such embodiment, it is possible to obtain a motion of the movable contacts in a very simple way and without any permanent mechanical linking of the movable contact assembly to the kinematic chain 5. This allows to reduce the number of components, thereby reducing the manufacturing, installation and maintenance costs. As a further advantage, it is worth noting that the mechanical energy dissipation is considerably reduced with respect to conventional kinematic chains, due to the very low frictions of the first sliding element 51, and in particular of the first 52 sliding surface, with the corresponding coupling elements, i.e. the roller coupling the sliding surface 52 with the movable contact.

Preferably, the sliding element 51 of the kinematic chain 5 is made of insulating material.

One of the main advantages of the circuit breaker of the present invention according to this latter embodiment, resides in that the various components of the circuit breaker 1 can be pre-assembled outside the main production line of the circuit breaker 1. Then the pole assembly 2 including the interruption chambers 6, 7 and 8, the actuator 3 and the kinematic chain 5 can be easily assembled on the insulating base frame 4 by fixing them to the base frame 4 without any permanent mechanical connection between the pole assembly 2 and the kinematic chain 5, since the operative connection between them is achieved via the sliding coupling of the sliding surface 52 with the movable contact assembly. The assembly procedure of the circuit breaker 1 is therefore greatly simplified.

In a particular embodiment of the Medium Voltage circuit breaker 1 according to the invention, the circuit breaker 1 further comprises a control box housing one or more auxiliary device of said circuit breaker 1. In other words, all the auxiliaries, (e.g. trip, blocking, undervoltage coils, motorgear, auxiliary contacts) can be conveniently housed in a single box, which is positioned in said insulating base frame 4. The box is preferably pre-wired (e.g. by co-moulding wiring) and has plug (or socket) installed on it. Also, the whole auxiliaries assembly can be pre-tested out of the assembly line and then positioned in the insulating base frame 4.

With the above solution it is possible to optimize the needs, e.g. minimize the number of coils, obtain a wider voltage range, have new auxiliary contacts, etc. Also, from a production standpoint, such solution has the great advantage that all auxiliaries are grouped together, pre-tested and then positioned in the insulating base frame 4, together with the kinematic chain 5, the pole assembly 2 and the actuator 3, with a consistent reduction of production times and costs.

It is clear from the above that medium voltage circuit breaker of the invention have a number of advantages with respect to medium voltage circuit breaker of known type.

In particular, as explained above, the production process for manufacturing the circuit breaker 1 is greatly simplified with respect to the conventional circuit breaker. As a matter of fact, the various sub-components of the circuit breaker (e.g. pole assembly, actuator, kinematic chain) can be pre-assembled outside the main production line of the circuit breaker. The sub-components are then fixed to the insulating base frame in a very quick and highly automatized way.

The use of an insulating base frame allows to have a current path exit through the lower base of the circuit breaker, without resorting to complicated and costly solutions.

Also, in the medium voltage circuit breaker of the invention, the electrodynamic stresses are reduced, since a linear current path (i.e. a current path parallel to the longitudinal axis of the interruption chamber) can be obtained.

It is also worth mentioning that the circuit breaker of the invention has a greater flexibility, in terms of range of applicability, with respect to the conventional circuit breaker. As explained above, it is possible with only a few accessories (e.g., circuit breaker arms and insertion contacts) to change the configuration of the circuit breaker and adapt it to the intended panel configuration (i.e., fixed or withdrawable configuration, kind of compartment segregation, etc.).

The medium voltage circuit breaker thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

The invention claimed is:

1. A Medium Voltage circuit breaker comprising a pole assembly having, for each phase, an interruption chamber configured to house a first fixed contact and a second movable contact reciprocally couplable/uncouplable between an open and a closed position, said circuit breaker further comprises:

an actuator to actuate the opening and closing operation of said circuit breaker said actuator being accommodated in a casing;

a kinematic chain operatively connecting the actuator to at least said second movable contact; and an insulating base frame supporting said pole assembly and said actuator;

wherein said insulating base frame comprises a base wall and first, second and third lateral walls, a plurality of fixing points being present in the volume defined by said base and lateral walls for fixing said pole assembly and said actuator to said insulating base frame;

wherein said insulating base frame comprises a plurality of cavities passing through said base wall and a front portion obtained in said base wall and adjacent to said cavities;

wherein said interruption chambers are positioned in correspondence of said cavities and are fixed to said base frame at said fixing points;

wherein the casing of said actuator is positioned in correspondence of said front portion and is fixed to said base frame at said fixing points;

wherein said kinematic chain is housed in said base frame in a position between said front portion and the cavities housing said interruption chambers; and wherein no permanent mechanical connection is present between said kinematic chain and said pole assembly.

2. The Medium Voltage circuit breaker according to claim 1, wherein said kinematic chain being housed in said insulating base frame.

3. The Medium Voltage circuit breaker according to claim 2, wherein said kinematic chain comprises a sliding element operatively connected to said actuator, said sliding element having a first sliding surface operatively coupled to said movable contact and being movable between a first, open, position and a second, closed, position.

4. The Medium Voltage circuit breaker according to claim 3, wherein said sliding element is made of insulating material.

5. The Medium Voltage circuit breaker according to claim 2, wherein said insulating base frame is made in one piece.

6. The Medium Voltage circuit breaker according to claim 2, wherein said pole assembly comprises, for each phase, at least a first terminal comprising a circuit breaker arm substantially aligned with the longitudinal axis of the interruption chamber of the corresponding phase.

7. The Medium Voltage circuit breaker according to claim 1, wherein said insulating base frame is made in one piece.

8. The Medium Voltage circuit breaker according to claim 7, wherein said pole assembly comprises, for each phase, at least a first terminal comprising a circuit breaker arm electrically substantially aligned with the longitudinal axis of the interruption chamber of the corresponding phase.

9. The Medium Voltage circuit breaker according to claim 8, wherein said circuit breaker arm comprises an insulating bushing.

10. The Medium Voltage circuit breaker according to claim 7, wherein said kinematic chain comprises a sliding element operatively connected to said actuator, said sliding element having a first sliding surface operatively coupled to said movable contact and being movable between a first, open, position and a second, closed, position.

11. The Medium Voltage circuit breaker according to claim 1, wherein said pole assembly comprises, for each phase, at least a first terminal comprising a circuit breaker arm substantially aligned with the longitudinal axis of the interruption chamber of the corresponding phase.

12. The Medium Voltage circuit breaker according to claim 11, wherein said circuit breaker arm comprises an insulating bushing.

13. The Medium Voltage circuit breaker according to claim 11, wherein said kinematic chain comprises a sliding element operatively connected to said actuator, said sliding element having a first sliding surface movable between a first, open, position and a second, closed, position.

14. The Medium Voltage circuit breaker according to claim 1, wherein said insulating base frame comprises a base wall and a first, a second and a third lateral wall, a plurality of fixing points being present in the volume defined by said base and lateral walls for fixing said pole assembly and said actuator to said insulating base frame.

15. The Medium Voltage circuit breaker according to claim 1, wherein said kinematic chain comprises a sliding element operatively connected to said actuator, said sliding element having a first sliding surface movable between a first, open, position and a second, closed, position.

16. A Medium Voltage circuit breaker wherein it comprises a pole assembly having, for each phase, an interruption chamber configured to house a first fixed contact and a second movable contact reciprocally couplable/uncouplable between an open and a closed position, said circuit breaker further comprises an actuator to actuate the opening and closing operation of said circuit breaker and an insulating base frame supporting said pole assembly and said actuator;

wherein said pole assembly comprises, for each phase, at least a first terminal comprising a circuit breaker arm electrically substantially aligned with the longitudinal axis of the interruption chamber of the corresponding phase;

wherein said circuit breaker arm comprises a grading bushing having an insulation system based on grading capacitors electrical field control.

17. The Medium Voltage circuit breaker according to claim 16, wherein said grading capacitors electrical field control comprises, on the external surface of said circuit breaker arm, a metallic concentric layer.

* * * * *